United States Patent [19]

Straffi

[11] 4,213,499

[45] Jul. 22, 1980

[54] SUPPORTING GRATE FOR TUBE PLATES AND RELATIVE ASSEMBLING IN A STEAM GENERATOR OR THE LIKE

[75] Inventor: Franco Straffi, Dresano, Italy

[73] Assignee: Breda Termomeccanica S.p.A., Milan, Italy

[21] Appl. No.: 862,184

[22] Filed: Dec. 19, 1977

[30] Foreign Application Priority Data

Dec. 21, 1976 [IT] Italy ..... 30702 A/76

[51] Int. Cl.[2] ..... F28F 9/18

[52] U.S. Cl. ..... 165/162; 122/510

[58] Field of Search ..... 165/162, 163, 76; 122/510, 11, 12

[56] References Cited

U.S. PATENT DOCUMENTS

| | | | |
|---|---|---|---|
| 2,987,382 | 6/1961 | Endter et al. | 165/76 |
| 3,212,570 | 10/1965 | Holman | 165/162 |
| 3,286,767 | 11/1966 | Evans | 165/163 |
| 3,420,297 | 1/1969 | Romanos | 122/510 |
| 3,907,031 | 9/1975 | Tegethoff | 165/162 |
| 3,941,188 | 3/1976 | Scheidl | 165/162 |
| 4,036,461 | 7/1977 | Soligno | 165/162 |

FOREIGN PATENT DOCUMENTS 2541986 12/1976 Fed. Rep. of Germany ..... 165/162

*Primary Examiner*—Samuel Scott
*Assistant Examiner*—Theophil W. Streule, Jr.
*Attorney, Agent, or Firm*—Fleit & Jacobson

[57] ABSTRACT

The invention relates to a grate for supporting tube plates for assembling in a steam generator or the like. The grate is characterized in that the ends of the plates forming the grating penetrate into and are received, at least partially, without any longitudinal gap or clearance in grooves in the frame body, which frame is preferably formed by three rings, at least partially superimposed, of which the intermediate ring has said grooves, while the other two upper and lower rings are secured to said intermediate ring and enclose therebetween the ends of the individual plates threaded in the grooves of the intermediate ring; a diametrical stiffening device secured by welding is also provided. It is the object of the invention to provide an economical and efficient grate allowing to avoid welding of the plates to one another and between said plates and frame, while ensuring the greatest reliability.

12 Claims, 16 Drawing Figures

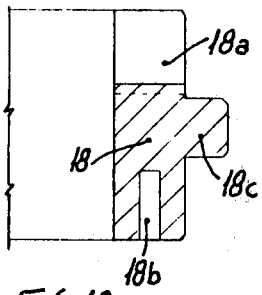
FIG. 10
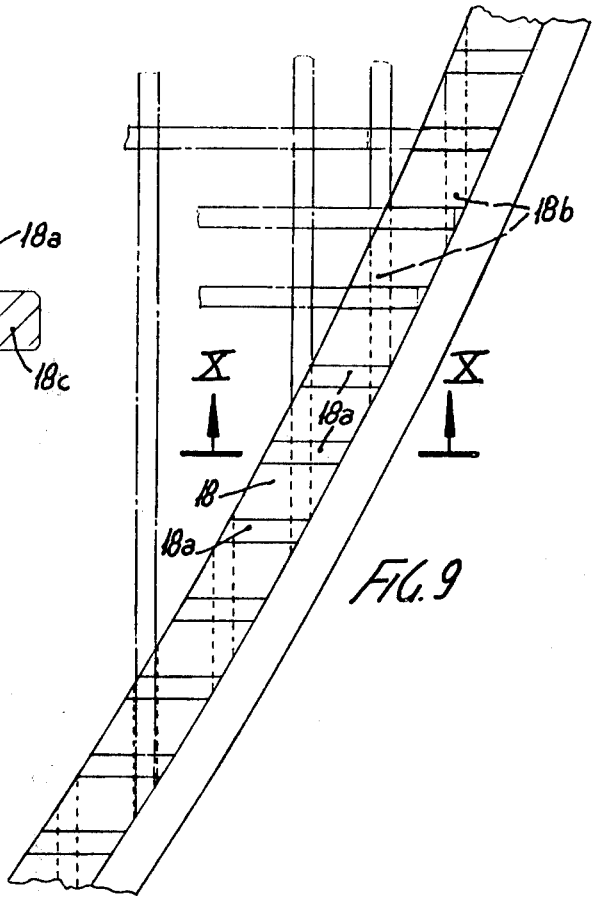
FIG. 9
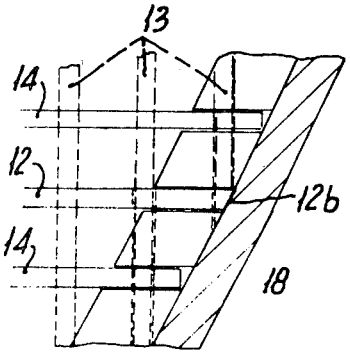
FIG. 11
FIG. 12
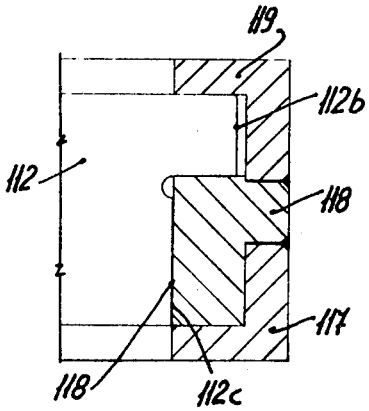

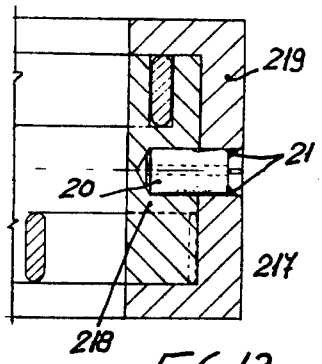
FIG. 13
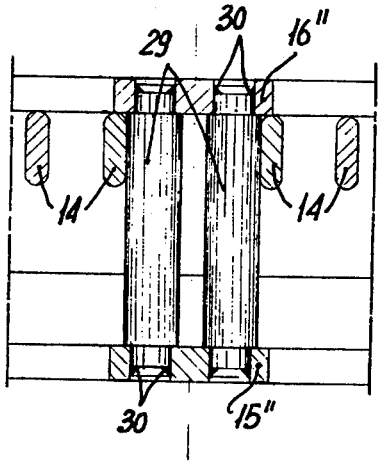
FIG. 14
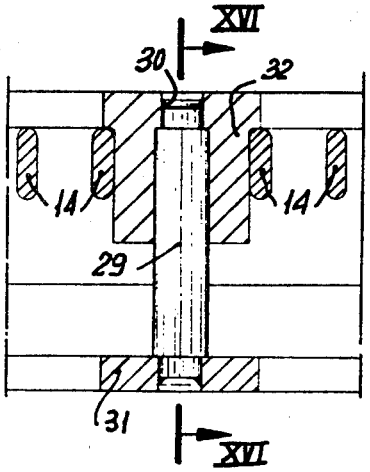
FIG. 15
FIG. 16
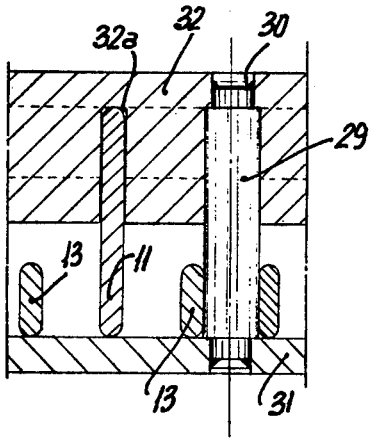

SUPPORTING GRATE FOR TUBE PLATES AND RELATIVE ASSEMBLING IN A STEAM GENERATOR OR THE LIKE

This invention relates to grates for supporting and spacing the tubes of a steam generator or a heat exchanger.

Many grates of this type are known which, however, suffer from the disadvantage of being expensive, difficult to build up, do not provide a sufficiently positive grating and are scarcely reliable.

It is the primary object of the present invention to provide a grate in a highly economical and efficient manner, avoiding welds between the plates or between the plates and frame, and to provide a grate which is reliable.

This object has been attained by developing a grate formed of a set of primary plates and a set of secondary plates that are retained within a frame comprising three rings, that is an intermediate milled ring for accomodating the ends of the grating plates, and two outer rings of L-shaped cross-section, arranged at facing position to each other and such as to retain with one flange of said L all of the plate ends against said frame, whereas at least some plates are longitudinally clamped against one or more of said rings, said plates taking up the function of struts and said rings being secured to one another.

Preferably, the plates acting as strut members are the primary plates.

It is also provided that said strut acting plates are machined at the ends thereof, so that the surface thereof contacting the frame will perfectly adhere thereto at that location.

According to a solution of the invention, it is provided that said strut acting plates are clamped against the inner surfaces of the two outer rings.

On the other hand, a variant to the above solution provides that said strut acting plates are clamped against the inner surface of the intermediate ring.

It is usually preferred that plate clamping against the rings is carried out by an interference assembly.

Fastening of the three rings to one another is preferably effected by welding sections or lengths provided on the outer wall of the frame. However, clamping pins could be also provided and then welded in turn. Other fastening systems are also possible.

A solution is also provided, according to which the grate is diametrically stiffened by plates disposed over and under the grating plates.

Grate assembling in the tube plate shell is preferably carried out by means of wedges that are inserted in suitable slots having inclined walls. Thus, said wedges act both as antirotational keys and positioning members for the grate relative to the tube plate.

Preferably, the grates are secured to the shell also in a direction perpendicular to the plane thereof by means of some top blocks and a continuous bracket having the function of supporting the grate and simultaneously removing a by-pass of water/steam mixture comprising the gap between the frame of each grate and shell. A further solution provides to weld said wedges to both said shell and grate.

According to the present invention, the construction is provided for circular grates and semicircular grates.

The invention will now be more fully described in connection with some exemplary embodiments as shown in the accompanying drawings, in which:

FIG. 9 is a top view of a portion of the milled intermediate ring;

FIG. 10 is a sectional view taken along line X—X of FIG. 9;

FIG. 11 is a sectional view taken along line XI—XI of FIG. 5;

FIG. 12 is a sectional view similar to that of FIG. 5, but showing a variant with respect to the former;

FIG. 13 is a sectional view similar to that of FIG. 5, but showing a variant of the latter;

FIG. 14 is a sectional view taken along line XIV—XIV of FIG. 2;

FIG. 15 is a view similar to that of FIG. 14, in which a variant of the latter is shown; and FIG. 16 is a sectional view taken along line XVI—XVI of FIG. 15.

Figure 1:
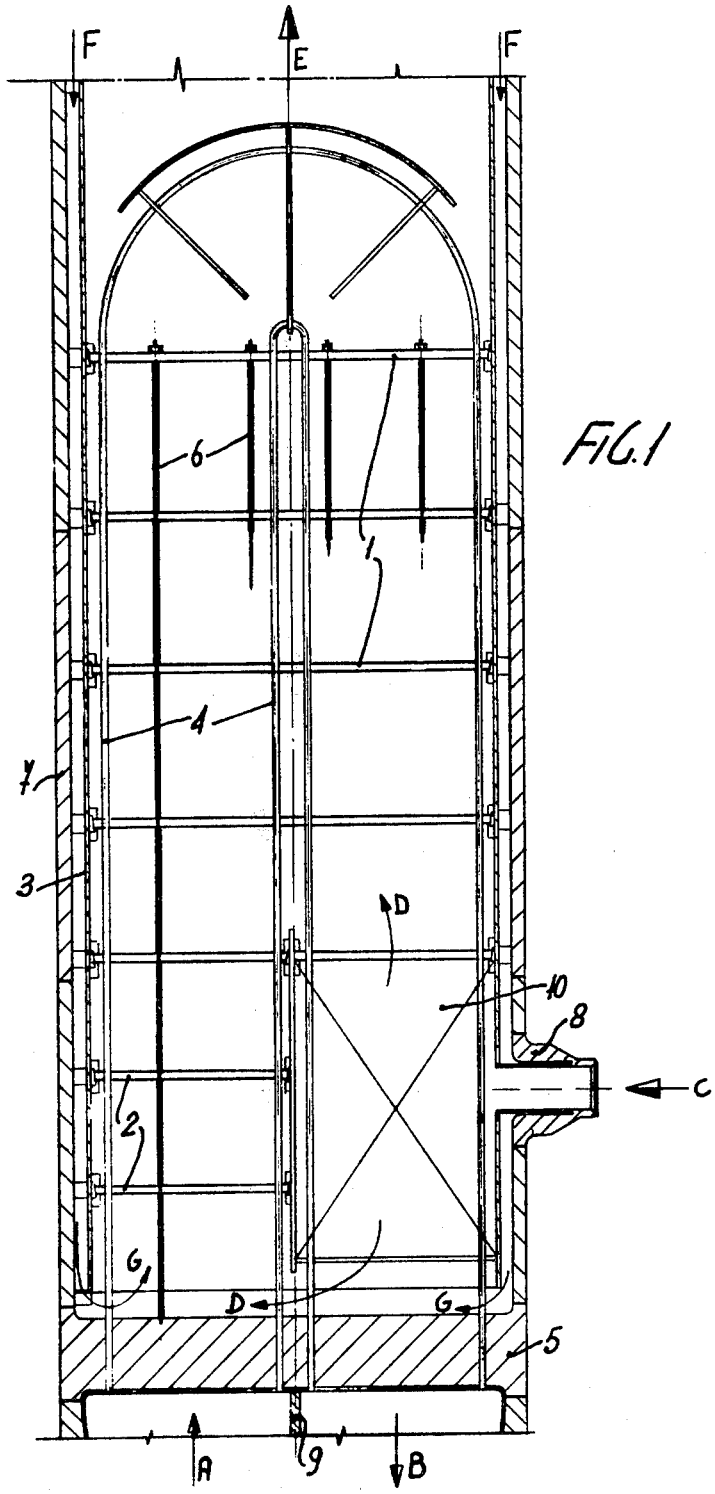
FIG. 1 is a schematic sectional view through a steam generator.

First referring to FIG. 1, it will be seen that housing or shell 3 of the tube plate internally comprises a number of circular grates 1 and semicircular grates 2 supporting tubes 4 for the sake of clarity only the extreme tubes, namely the central tube and the outermost tube, have been shown. Tubes 4 and spacer-tie rods 6 are secured to tube plate 5. A supply water opening 8 is provided in outer shell 7. A partition 9 is also provided and divides the primary side water tank into two parts.

Primary hot water enters the water tank underlying said tube plate 5 in the direction of arrow A, runs through the tube plate yielding its heat to the secondary fluid side, and finally exits in the direction of arrow B. The entrance of the secondary side supply water is through opening 8 in the direction of arrow C, and this water first passes through a preheater 10 and then, by exiting in the direction of arrows D, vertically travels through the steam generator boiling at the contact with the tube plate and escapes at the top in the direction of arrow E in the form of water-steam mixture. The recirculation of saturated water from the successive separating stages of said water-steam mixture arrives at the descending branch in the direction of arrows F and re-enters the boiler in the direction of arrows G, getting mixed with water from the preheater (arrows D).

Figure 2:
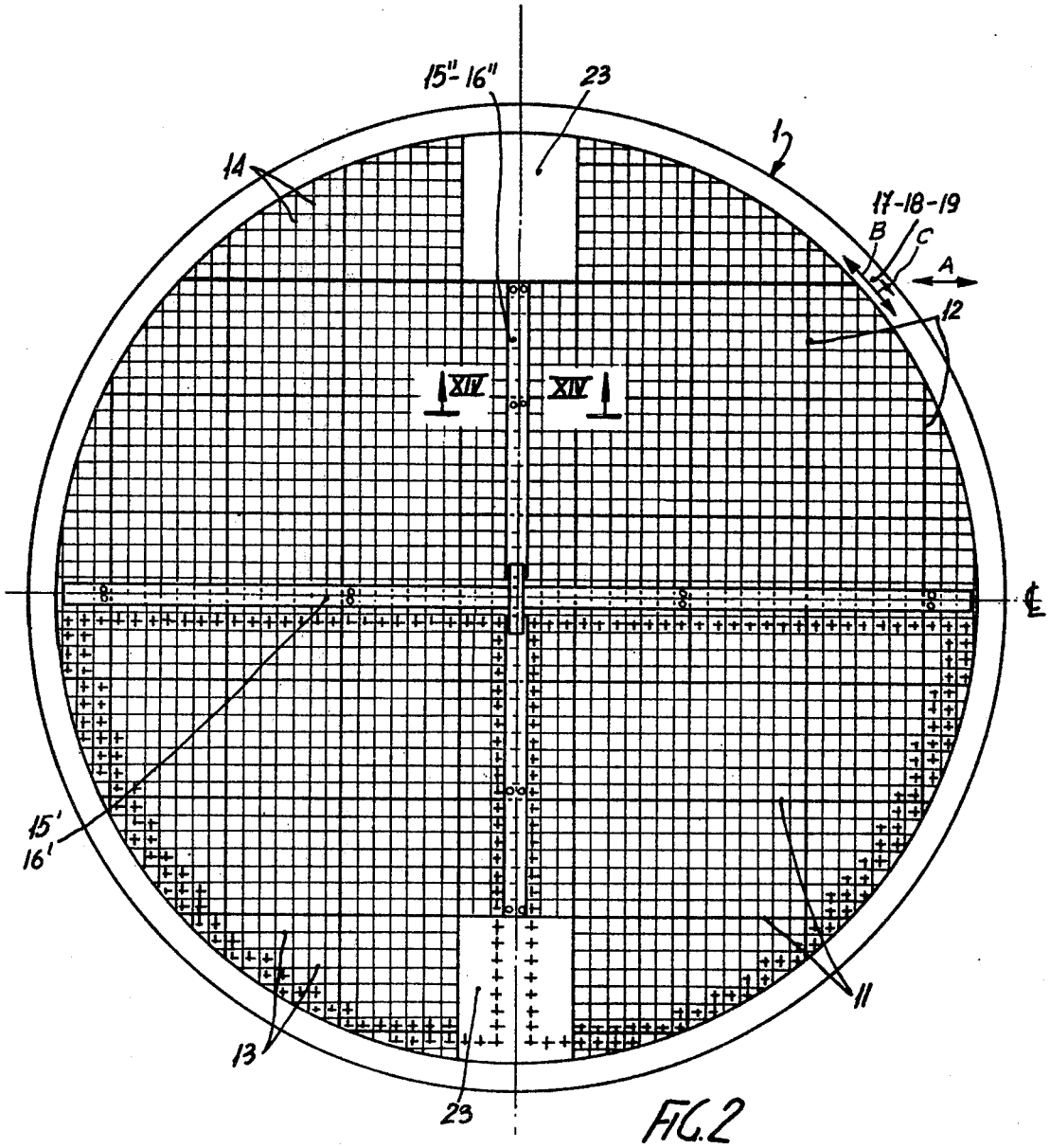
FIG. 2 is a schematic plan view of a circular grate.

Referring now to FIG. 2, a grate 1 of a circular shape will be first described. The frame is formed of two circular rings 17 and 19 of L-shaped cross-section and arranged at symmetrical position to each other, and an intermediate ring 18, the latter accomodating therein the ends of plates forming the tube supporting grating.

Said grating comprises top carrying plates 11 and 12 and bottom plates 13 and 14. Preferably, said top plates 11 and 12 are of the same height or level as said intermediate ring 18 and externally of a downward or upward facing L-shape, which forms outer projecting portions 11*a* and 12*a* (FIG. 4) penetrating into corresponding grooves in intermediate frame ring 18. The grating provides lower and upper plates 13 and 14, respectively, also penetrating into corresponding grooves in said intermediate frame ring 18. Obviously, said plates 13 and 14 are constructively identical to one another, the only difference being the position thereof within the grate. The same is true for the two top plates 11 and 12. Intermediate plate 18 (FIGS. 9 and 10) has grooves or millings for receiving all of the above mentioned plates. The grooves provided in the top portion are designated at 18*a*, while the lower or bottom portion has provided therein the grooves or millings 18*b* which in this case are arranged at 90° relative to grooves 18*a*. Should the grating not be at 90° but, for example, at 60°, said grooves or millings 18*a* and 18*b* would also staggered by 60°.

In FIG. 2, the position of the tubes has been shown by indicating only the axes of the outermost tubes in the lower semicircumference of grate 1, while for the sake of clarity the indication of the position for all the other tubes has been omitted.

The grating is secured or kept together by means of stiffening bars sandwich-like mounted, and designated at 15', 16', and 15'', 16''. Two manholes 23 are also provided.

Figure 3:
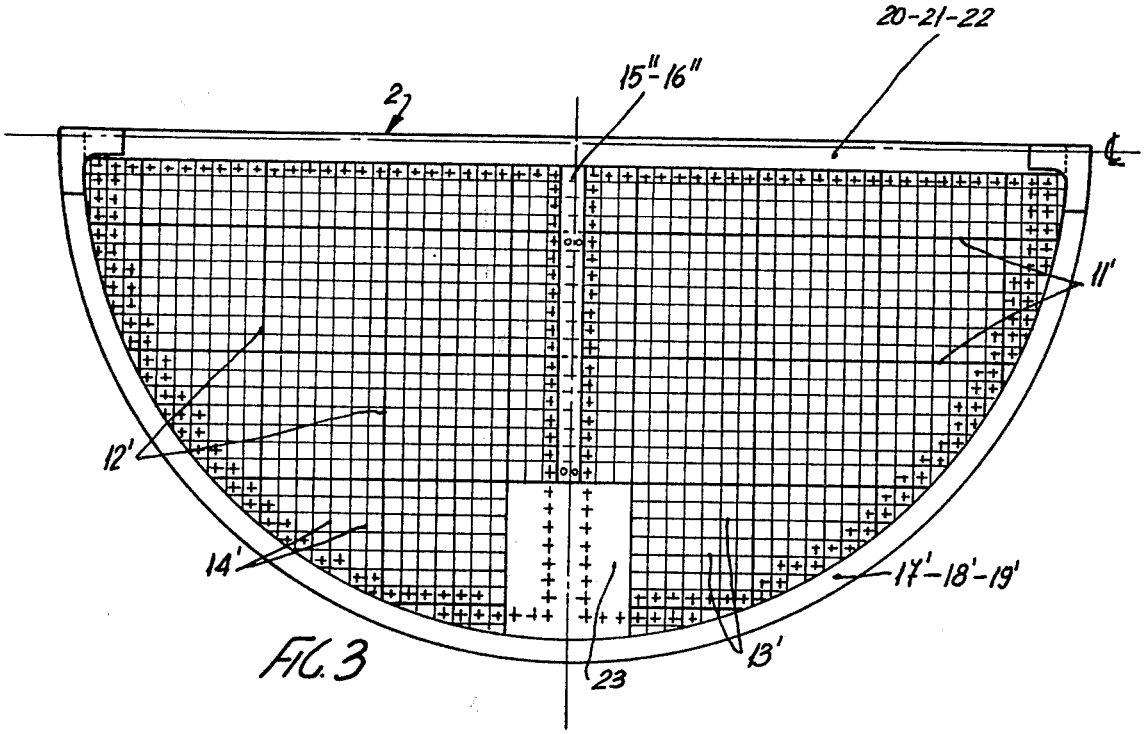
FIG. 3 is a schematic plan view of a semicircular grate.

Semigrate 2 (FIG. 3) is made quite similar to grate 1 and is particularly composed of a grating comprising lower and upper main plates 11' and 12', and secondary plates 13' and 14', whereas the frame is formed of a semicircular portion comprising half-rings 17', 18' and 19', and a straight frame portion comprising pieces or members 20, 21 and 22, which are straight, but quite similar to pieces or members 17, 18 and 19 above described.

Figure 5:
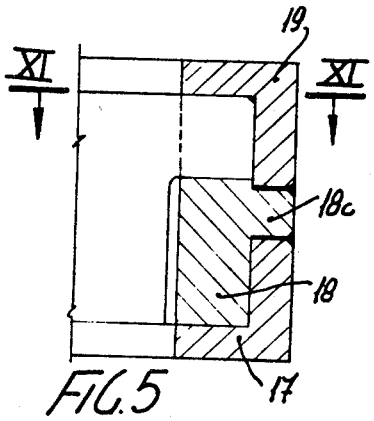
FIG. 5 is a view showing the same grate portion of FIG. 4, when all the pieces or members are assembled.
Figure 4:
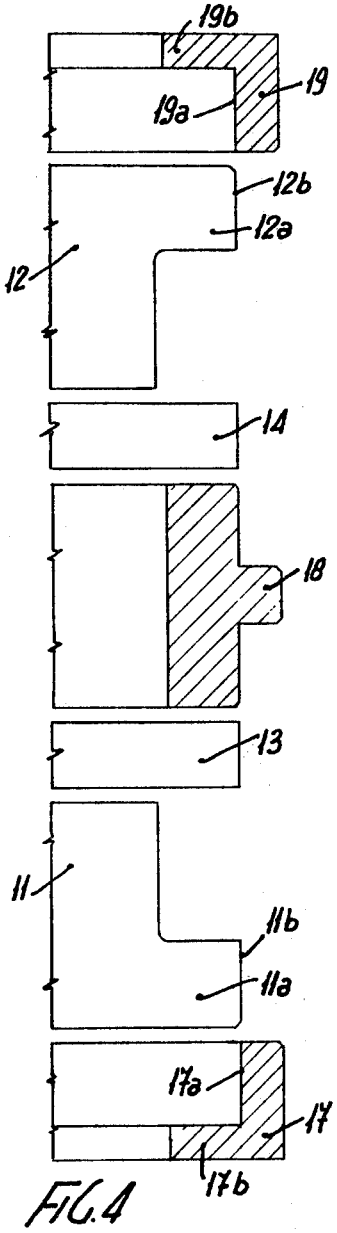
FIG. 4 is an exploded sectional view of a frame portion with associated plates forming the adjacent grating, according to a first embodiment of the invention.

A more detailed description will now be given for the individual constructive parts of the grate, starting with the description of an embodiment shown in FIGS. 4 and 5. The length of top carrying plates 11 and 12 is such that the end surface thereof 11*b* and 12*b* is accomodated by easy or slight interference fit within the inner surface 17*a* and 19*a* of lower and upper rings 17 and 19, respectively. Preferably, the surfaces of plates 11*b* and 12*b* are machined so as to bear throughout the thickness thereof against annular surfaces 17*a* and 19*a*. This has been shown in FIG. 11. As shown, said plates 11 and 12 have an inclined end portion perfectly conforming to the surface portion 17*a* or 19*a* of rings 17 and 19 that will be assembled on ring 18. On the other hand, the end surfaces of bottom plates have not been generally machined.

In this embodiment, in addition to having grooves or millings 18*a* and 18*b* receiving the ends of all the plates, said intermediate ring 18 also has a rear formation in the form of a collar facilitating the assembling of said two lower and upper rings. This collar has been designated at 18*c*. Said collar 18*c* allows rear welding of the lower and upper rings against the intermediate ring, securing the three rings to one another, after that said rings have been assembled by interference fit on the plates and have blocked the latter by means of their upper and lower surfaces 17*b* and 19*b*, respectively. Upon completion of the assembly, the position of the several pieces or members has been shown in FIG. 5.

An alternative solution of plate assembling as forced on the frame has been shown in FIG. 12. In this figure, it will be seen that the primary or top plate 112 has been made so that its frame contacting surface is the surface designated at 112*c*, the latter being preferably machined, whereas surface 112*b* does not bear against upper ring 119. In this case, upper and lower rings 119 and 117, respectively, have the only function of holding the plates within the frame, whereas intermediate ring 118 serves both to retain the ends of all the plates within its grooves or millings, and to provide a bearing surface 118*a* for a strut-like operation of said plates.

Clamping of the three rings making up the frame, that is the three upper, lower and intermediate rings to one another may be provided as shown in FIG. 13. Intermediate rings 218 is not provided with a collar, but is fully comprised within rings 217 and 219. Holes are drilled along the outer periphery of these rings and receive pins 20 inserted therein and then welded at 21.

Figure 6:
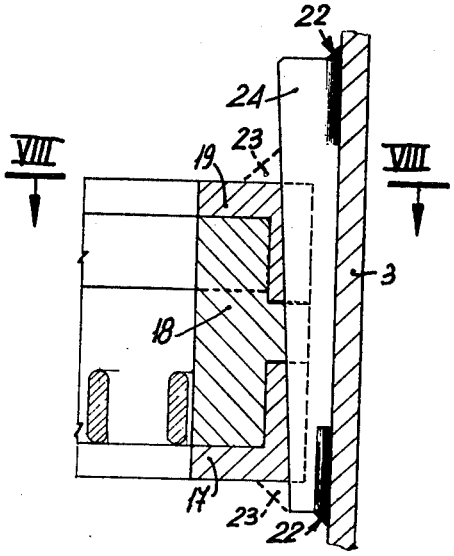
FIGS. 6 and 7 are two sectional views respectively showing a frame portion and a portion of the adjacent shell, wherein the anchoring of the grate to the tube plate shell have been shown.
Figure 8:
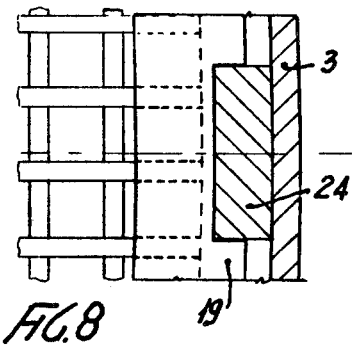
FIG. 8 is a sectional view taken along line VIII—VIII of FIG. 6.

FIGS. 6 and 8 are, respectively are a sectional view of the frame with the relative shell or housing portion comprising an antirotational positioning key and relative top view. Key 24 has been made in the form of a wedge, so that its more or less deep penetration may serve to position the grate within its own plane, while at the same time the side walls of the key serve as an antirotational key, that is to say, so as to ensure that a rotation of shell or housing 3 causes the simultaneous rotation of all the grates therein contained. After its positioning, said key is welded as shown at 22.

Figure 7:
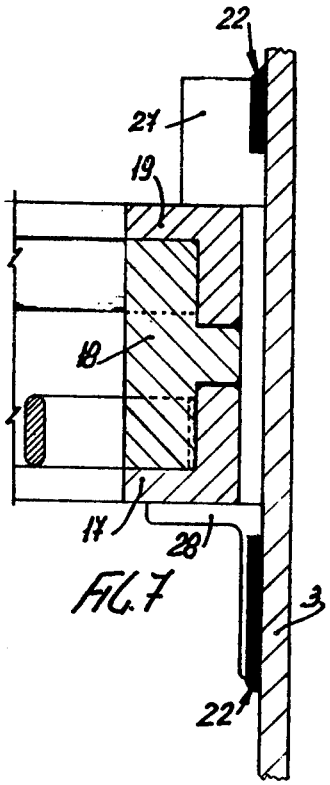

A sectional view of the frame portion has been shown in FIG. 7, in which the grate fastening in a direction perpendicular to its own plane can be seen. At the bottom, an L-shaped bracket 28 has been provided, which bracket is preferably continuous or segmented, so as to act as a closure for the by-pass that could be built up between the surface of shell or housing 3 and the rear wall of the grate frame. At the top of the grate, some blocks 27 are positioned as provided.

Alternatively, positioning of the grate in a direction at right angles to the grate plane could also be effected by merely welding the several antirotational keys to the grate, as shown in FIG. 6, at the location indicated by a dashed line 23.

A system for diametrical stiffening of the grate is also provided. This system has been shown in FIG. 14, which is a sectional view taken through a clamping zone of the two plates 15'' and 16''. For example, such a clamping may be effected by two pins 29 that are welded at 30 respectively to said plates 15'' and 16'', said pins being dimensioned so as to hold the two plates close to each other. This stiffening system comprising said plates 15'' and 16'' and relative fastening pins 29 substitutes for one or more lower plates.

A variant to the solution described with reference to FIG. 14 has been shown in FIGS. 15 and 16. In these figures, plates 15'' and 16'' are replaced by a plate 31 and a comb bar 32, the latter having such a size as to deeply penetrate into the grating, so that said bar should have comb millings 32*a*, into which the top or upper plates 11 penetrate. Said plate 31 and comb bar 32 are clamped to each other by means of pins 29 that are welded at 30.

In both solutions, plates 15', 15'', 16' and 16'', or 31 and 32 can be welded.

Constructive detail modifications are possible with respect to the foregoing description.

What is claimed is:

1. A grate assembly for supporting tubes within a shell of a heat exchanger or steam generator, the assembly comprising:

at least two plates comprising gratings; and a frame formed of an upper ring, an intermediate ring and a lower ring fastened together to form a single continuous structure, said rings being arranged at least partially superimposed one on another, said intermediate ring having grooves formed therein for receiving the ends of the gratings, said upper and lower rings being secured to said intermediate ring for enclosing therebetween the ends of the gratings which are arranged in their respective grooves formed in said intermediate ring, said grooves being formed such that at least one of said at least two plates is accommodated therein without any longitudinal clearance in said frame, said at least one of said at least two plates having an end surface, said frame having an inner surface which includes a bearing surface, each respective end surface of said at least one of said at least two plates being shaped so as to coincide with and perfectly adhere to said bearing surface of said inner surface of said frame, whereby said at least one of said at least two plates always acts as a strut.

2. A grate assembly according to claim 1, wherein at least one of said gratings is mounted by interference fit within said frame.

3. A grate assembly according to claim 1, wherein said at least one of said at least two plates accommodated without any longitudinal clearance in said frame is a primary, tube carrying plate.

4. A grate assembly according to claim 1, wherein the upper ring, the lower ring and the intermediate rings are fastened together by welding.

5. A grate assembly according to claim 4, wherein said intermediate ring has a rear collar, said upper and lower rings are both arranged on said rear collar, and said upper and lower rings are welded to the intermediate ring by means of said rear collar.

6. A grate assembly according to claim 4, wherein said upper and lower rings are joined to said intermediate ring by means of pins inserted in suitable holes in said rings, and said pins are welded to said upper and lower rings.

7. A grate assembly according to claim 1, wherein said inner surface which includes said bearing surface comprises an inner surface of said intermediate ring.

8. A grate assembly according to claim 1, further including a stiffening device comprising two plates arranged on each other under said gratings and retained to each other by means of pins welded to said two plates.

9. A grate assembly according to claim 8, wherein said at least one of said at least two plates accommodated without any longitudinal clearance in said frame is a primary, tube carrying plate, and further comprising a comb bar arranged to cross with said primary, tube carrying plate, wherein said comb bar partially penetrates into said gratings and is milled at each crossing with said primary, tube carrying plate.

10. A grate assembly according to claim 1, wherein said frame has an outer surface, and the outer surface of said frame includes keyways having inclined surfaces, said keyways being capable of receiving wedges, said wedges being welded to said shell.

11. A grate assembly according to claim 1, wherein said grate assembly has an axial position within said shell provided at a bottom thereof by an L-shaped bracket and at a top thereof by blocks.

12. A grate assembly according to claim 1, wherein the grate assembly is axially fastened to the shell by fastening a wedge to the grate assembly by means of a weld, whereby said wedge is in abutting relationship with said shell.

* * * * *

UNITED STATES PATENT AND TRADEMARK OFFICE

CERTIFICATE OF CORRECTION

PATENT NO. : 4,213,499

DATED : July 22, 1980

INVENTOR(S) : Franco STRAFFI

It is certified that error appears in the above—identified patent and that said Letters Patent is hereby corrected as shown below:

Figure 2 of the drawings, delete the designations A, B, and C, as well as the associated directional arrows.

Signed and Sealed this

*Twenty-eighth* Day of *October 1980*

[SEAL]

*Attest:*

SIDNEY A. DIAMOND

*Attesting Officer*

*Commissioner of Patents and Trademarks*